United States Patent [19]

Thuse

[11] Patent Number: 4,939,042

[45] Date of Patent: Jul. 3, 1990

[54] FATIGUE LIFE OF A COMPONENT SUCH AS A BAR

[75] Inventor: Erik Thuse, Santa Clara, Calif.

[73] Assignee: FMC Corporation, Chicago, Ill.

[21] Appl. No.: 322,840

[22] Filed: Apr. 17, 1989

Related U.S. Application Data

[62] Division of Ser. No. 118,062, Nov. 9, 1987, Pat. No. 4,836,866.

[51] Int. Cl.[5] ..... C21D 9/00

[52] U.S. Cl. ..... 428/610; 148/150; 148/902

[58] Field of Search ..... 148/131, 150, 902; 266/103; 428/610

[56] References Cited

U.S. PATENT DOCUMENTS

| | | | |
|---|---|---|---|
| 3,125,469 | 3/1964 | Schechter | 148/12 |
| 3,202,555 | 8/1965 | Armstrong | 148/131 |
| 3,477,884 | 11/1969 | Schlicht | 148/150 |
| 3,562,030 | 2/1971 | Seulen et al. | 148/131 |
| 4,141,125 | 2/1979 | Blunier | 29/148.3 |
| 4,321,098 | 3/1982 | Hayden | 148/14 |
| 4,404,047 | 9/1983 | Wilks | 148/131 |

FOREIGN PATENT DOCUMENTS

| | | |
|---|---|---|
| 2217425 | 6/1974 | France . |
| 55-047321 | 3/1980 | Japan . |
| 57-181327 | 8/1982 | Japan . |
| 59-185734 | 10/1984 | Japan . |

OTHER PUBLICATIONS

Publication R&D Center Technical Report No. 13100 entitled Improvement in the Fatigue Behavior of Tank Track Pins by J. F. Wallace and A. M. Said.

Metal Handbook, Ninth Edition, vol. 4, Heat Treating, (American Society for Metals).

Dieter, *Mechanical Metallurgy*, pp. 580–581, 12–76.

*Primary Examiner*—S. Kastler

*Attorney, Agent, or Firm*—A. J. Moore; R. C. Kamp; R. B. Megley

[57] ABSTRACT

The outer surface of an elongated metal component such as a bar is rapidly heated by an induction coil and is thereafter cooled by a quenching spray while being subjected to tensile forces so high that the center portion of the bar approaches yield causing the bar to elongate slightly. The tension on the bar is released thereby obtaining high residual compressive surface stresses in the cooled outer layers of the bar which define an annulus and which shortens the bar slightly until compressive stresses in the surface layers equal the tensile stresses acting on the central sections of the bar thereby greatly improving the fatigue life of the bar.

13 Claims, 2 Drawing Sheets

FATIGUE LIFE OF A COMPONENT SUCH AS A BAR

This is a division of application Ser. No. 07/118,062, filed 11/9/87, Pat. No. 4,836,866.

BACKGROUND OF THE INVENTION

1. Field of the Invention

The present invention relates to improving the fatigue life of a component such as an elongated bar, and more particularly pertains to improving the bar life by heating and thereafter quenching the bar as the bar is being stretched which provides residual compressive forces in an outer annulus of the bar after the stretching forces are released.

2. Description of the Prior Art

George Joseph Pat. No. 4,131,491 discloses a torsion bar and method of making the bar. The bar is through hardened to provide the desired core hardness and is thereafter induction heated followed by quenching to cause the outer surface or case to be hardened and to expand thereby providing high compressive stresses near the surface. However, the bar is not stretched during the induction heating and quenching process.

Blunier 4,141,125 discloses a method of mounting track pins by heating the ends of track pins above the critical temperature of steel and then quenching. The ends of the track pins are increased in volume by the process and are thus retained in the bores of the track links.

SUMMARY OF THE PRESENT INVENTION

In accordance with the present invention, the fatigue life of a component, hereinafter referred to as a bar, is improved by heating and quenching an annular outer portion of the bar while the bar is in tension. Induction heating followed by quenching is preferably used since induction heating allows the annular surface layers to become very hot while the following quenching step maintains the deeper layers of the core at substantially ambient temperature. When the tensioning force is released, the annular outer portion of the bar has high residual compressive stresses therein which improve the fatigue life of the bar when subjected to bending or axial loads.

DESCRIPTION OF THE PREFERRED EMBODIMENT

Prior to describing the details of the invention, it is believed that it would be helpful in understanding the invention to briefly explain what fatigue life is, and how bars processed in accordance with the present invention have improved fatigue life.

The fatigue life of a component can be considered as being the time it takes for a fatigue crack to develop at the surface of the material and propagate to a depth where the component no longer can handle the applied loads. Components will not fail in fatigue at locations subjected to only compressive or low tensile stresses, cracks already present will not propagate under these conditions. Fatigue cracks will propagate only at locations subjected to tensile stresses that at times exceed the endurance stress limit of the material. By creating components that have high residual compressive stresses in areas subjected to tensile forces, unlimited fatigue life could be expected for these components, provided that the tensile forces never cause tensile stress to exceed the endurance limit of the material that the components are made from. When a component, such as a cylindrical bar, a tubular bar, or other elongated sections have high residual compressive stresses in their outer annuluses; tensile stresses must exist in other areas of the cross section of the bar, which other areas will be called the core of the bar. At any cross section, the total force developed by the compressive stresses must equal that developed by the tensile stresses. It will be understood that in some cases when internal defects, such as voids or inclusions exist in the material below the depth where the tensile residual stresses exist, the fatigue life of the component may be less improved or, in some cases may not be improved at all.

Figure 1:
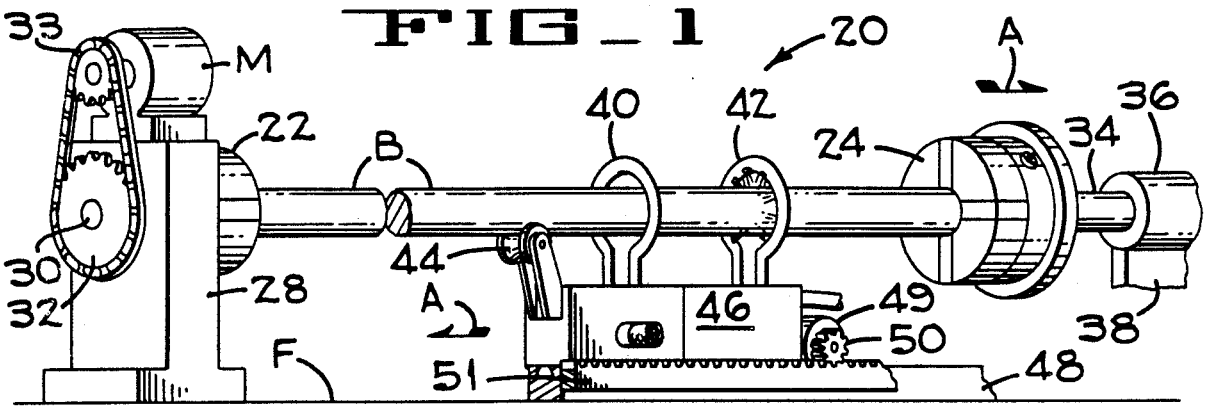
FIG. 1 is a schematic of an induction heating coil and quenching liquid coil shown in operative position surrounding a bar which is being heat treated in accordance with the present invention.

As diagrammatically illustrated in FIG. 1, a heating, quenching, and stretching apparatus 20 is disclosed for improving the fatigue life of a bar B by first heating and then quenching the bar while the bar is in tension and is slightly stretched. The bar may be a long bar, for example 20 feet long, or may be a short bar. If a long bar is used, it may be heat treated and quenched while under tension and thereafter be released from the apparatus and be placed in storage for subsequent use, or it may be heat treated and quenched under tension and thereafter be cut into short bars of a desired length such as bars used as track pins for off the road vehicles or the like.

In order to process elongated bars in accordance with the present invention, the ends of the bars are firmly gripped by chucks 22,24 (FIG. 1) which may be tightened and released by a socket type wrench (not shown) as is conventional in the art. The chuck 22 may be rigidly secured in fixed position to a stand 28 that is secured to a floor F; or when handling bars having a circular outer surface, may be rotatably supported on the stand 28 by a rotatable shaft 30 having a sprocket 32 rigidly secured thereto. Similarly, the chuck 24 may be rigidly secured to the piston rod 34 of a hydraulic cylinder 36 that is secured to the floor F by a stand 38. Alternately, the chuck 24 may be rotatably connected to the piston rod 34. When the chucks 22 and 24 are rotatably mounted, at least one gear motor M and chain drive 33 are provided to rotate the bar B while it is being tensioned and stretched by the hydraulic cylinder 36. If large diameter bars B are being processed, a second motor (not shown) may be secured to the stand 38 and be operatively connected to the chuck 36 thereby driving both ends of a long bar B being processed at a rate of about 100 to 150 revolutions per minute. An induction heating coil 40, a quenching liquid spray coil 42, and a bar supporting roller 44 (used only for long bars) are supported on a movable carriage 46. The carriage 46 is driven substantially the full length of a bar by a reversible gear motor 49 that is connected to the carriage 46 and drives a pinion 50 which engages a rack 51 secured to a slide way 48 thereby sequentially driving the carriage in both directions indicated by arrows A in FIG. 1 the full length of the bar B. The coils 40 and 42 are illustrated as having one winding but it will be understood that the coils may have more than one winding if desired.

A conventional heating power source (not shown) is connected to the induction coil; and a conventional pump and supply tank (not shown) are connected to the quenching coil 42 for directing a suitable quenching liquid spray onto the bar B after the bar is heated by the induction coil to immediately cool the outer surface of the bar as the carriage 46 is moved to the left in FIG. 1. After induction heating the bar, cooling the bar by quenching, releasing tension on the bar, and removing the bar from the apparatus 20; the bar will be termed a "processed bar" B'. It is understood that the term "processed bar" includes only that portion of the bar that is heated and quenched. In FIG. 1, the end portions of the bar B gripped by and adjacent to the chucks 22 and 24 are not processed.

Figure 2:
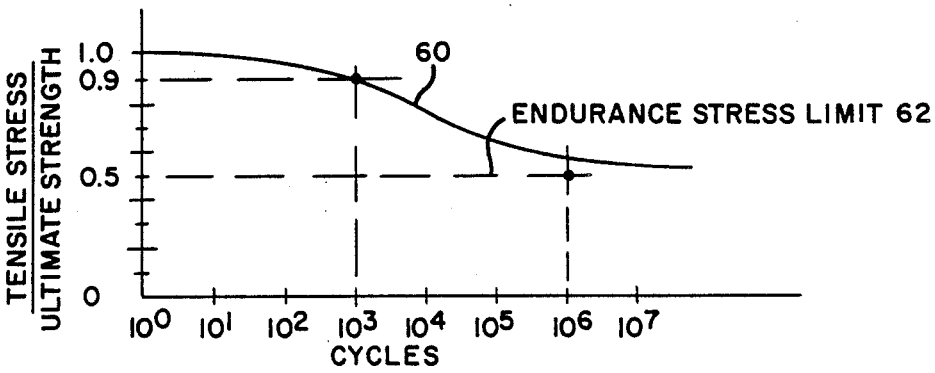
FIG. 2 is a stress-cycle diagram illustrating the stresses as a fraction of the ultimate strength of the material such as steels, and the number of cycles of 10 increasing exponentially.

The stress-cycle diagram of FIG. 2 illustrates a typical performance curve for steel components which are sound. The tensile stresses applied to the bars are given as a fraction of the ultimate strength of the material. The approximate fatigue life of the bar is given by the number of stress cycles applied to the processed bar.

It will be noted that the performance curve 60 indicates that the processed metal bar B' will fail during the first cycle when subjected to a tensile stress that equals its ultimate strength, and improves its endurance to an unlimited fatigue life when subjected to stresses no higher than one-half its ultimate strength as indicated by the line which is the endurance stress limit line 62.

Figure 3:
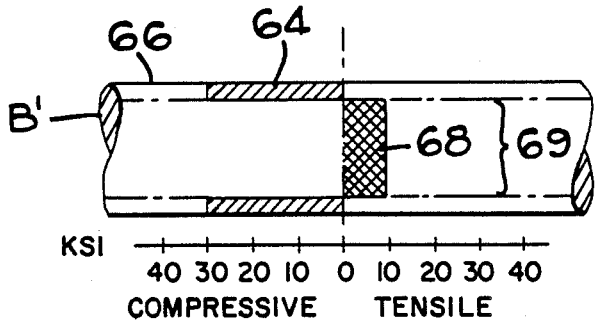
FIG. 3 is a residual stress diagram illustrating the ideal distribution of residual stresses in a cylindrical bar after being heat treated and quenched under a tensioning force and thereafter released but prior to having outside forces applied thereto.

FIG. 3 is a residual stress diagram of a relaxed processed bar B' having a circular cross section with no voids, inclusions, or other internal defects. The bar is at rest, i.e., is not being subjected to external forces. Induction heating, quenching and tensioning of the bar provides a residual compressive stress 64 through the entire processed length of the bar B'. If the residual compressive stress 64 acts in an annular area of up to about ⅛th of an inch thick surrounding the core 69 of a one inch diameter bar and its force per square inch is equal to a residual tensile stress 68 in the core, the annulus and core will have approximately the same area and accordingly the same tensile and compressive stresses.

The ideal residual compressive stress in a mild steel bar is indicated in FIG. 3 to be about 30,000 psi (30 ksi) while the residual tensile stress in the processed bar is indicated as being about 10,000 psi (10 ksi) which will act over a larger core area within the outer annulus 66. A bar of about 1.85 inches in diameter with a ⅛th inch thick processed annulus would support the above residual stresses.

Figure 4:
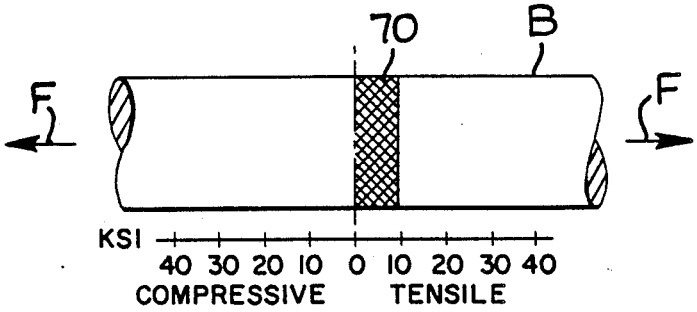
FIG. 4 is a stress diagram illustrating an unprocessed cylindrical bar subjected to axial tension showing no residual stresses.

FIG. 4 illustrates an unprocessed bar B having no residual compressive stresses in the bar. The bar B, however, is subjected to outside axial tensile forces F as indicated by the arrows thereby providing a tensile force of about 10 ksi. Tensile stresses 70 in the bar B are caused by the outside force F.

Figure 5:
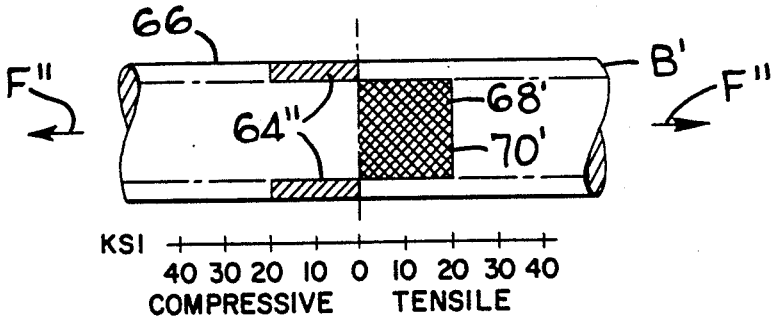
FIG. 5 is a stress diagram illustrating the processed bar of FIG. 3 when being subjected to axial forces with the maximum tensile stress being below the yield stress of the bar.

FIG. 5 illustrates a processed bar B' which was formed under exactly the same conditions used to form the bar B of FIG. 3. The bar B' is illustrated as being subjected to outside axial tensile forces F" which are the same forces as that applied to the unprocessed bar of FIG. 4. The two stress patterns shown in FIGS. 3 and 4 are superimposed to create the stress pattern 68', 70' and 64" shown in FIG. 5. The maximum tensile stresses of about 20 ksi are below the yield stress of the material so no yielding occurs.

Figure 6:
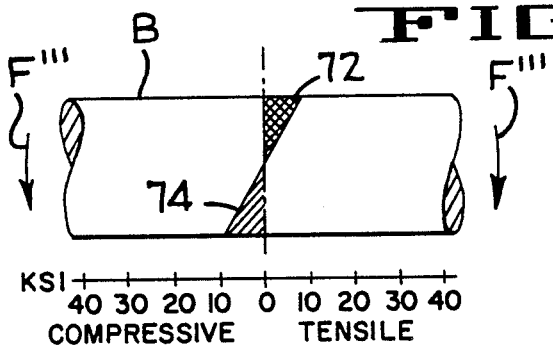
FIG. 6 is a stress diagram illustrating an unprocessed bar subjected to bending moments.

FIG. 6 illustrates an unprocessed cylindrical bar B that is subjected to pure bending moments illustrated by outside moments of force F''' which provide a tensile stress 72 and a compressive stress 74 which have maximum forces below 10 ksi, which is below the yield strength of the material.

Figure 7:
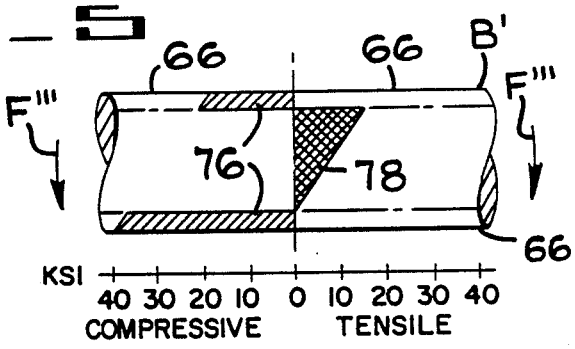
FIG. 7 is a stress diagram of the processed bar of FIG. 3 after being subjected to bending moments.

FIG. 7 discloses the processed bar B' when subjected to the pure bending forces F''' of FIG. 6, The two stress pattern shown in FIGS. 3 and 6 are superimposed to create the stress pattern shown in FIG. 7 with the residual compressive stress being indicated at 76. No yielding occurs since the tensile stress 78 of the inner portion of the bar B' does not exceed the yield strength of the material.

Figure 8:
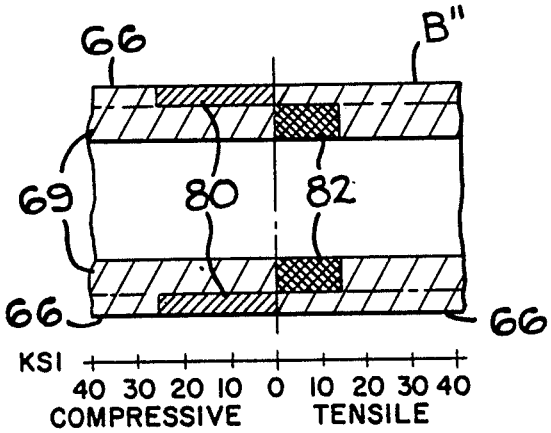
FIG. 8 is a stress diagram illustrating the ideal desired distribution of residual stresses in a tubular bar after the bar has been processed in accordance with the present invention but before outside forces have been applied thereto.

FIG. 8 illustrates the ideal desired stress distribution of residual stresses in an unstressed processed tubular bar B". An outer annulus of residual compressive stress 80 surrounds an inner annulus of residual tensile stress 82 which resists axial fatigue failure until an applied axial tensile force exceeds the residual compressive force by a significant amount.

Figure 9:
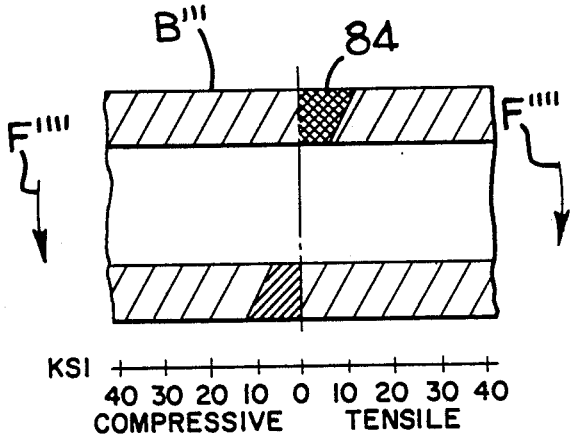
FIG. 9 is a stress diagram of an unprocessed tubular bar after bending moments below the yield strength of material have been applied thereto.

FIG. 9 illustrates the pattern of applied stresses in an unprocessed tubular bar B''' that is subjected to pure bending as indicated by the arrows representing moments of force F''''. No initial residual stresses were present. Accordingly, failure of the bar B''' may occur at the surface of the upper portion (FIG. 9) of the bar where the highest tensile stresses 84 exist.

Figure 10:
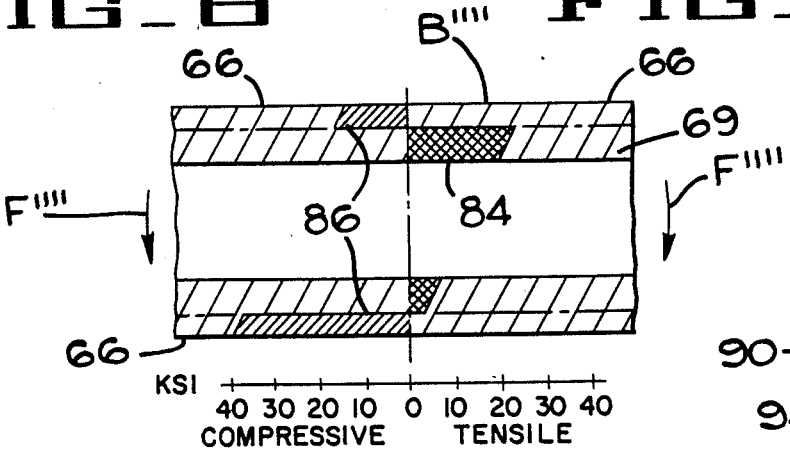
FIG. 10 is a stress diagram of the processed tubular bar of FIG. 8 after being subjected to the same bending moments as that applied in FIG. 9.

FIG. 10 illustrates the stress patterns of stresses in a processed tubular bar B'''' having residual stresses exactly as shown in FIG. 8 and then being subjected to pure bending using the same moments F'''' as used in FIG. 9. The two stress pattern shown in FIGS. 8 and 9 are superimposed to create the stress pattern shown in FIG. 10. Since residual compressive forces 86 are present in the upper (FIG. 10) portion of the tubular bar B'''', the most critical surface stresses occurring from the moment of force F'''' are still compressive and accordingly failure will not occur.

Although only solid cylindrical bars B having circular cross sections, and tubular bars B'', B''' and B'''' have been referred to above, it will be understood that elongated tubular or solid components of other cross sections; such as a rectangular or square beams, I-beams, T-beams, channels, and beams of other cross sections may also be processed by the method and apparatus of the present invention.

Figure 11:
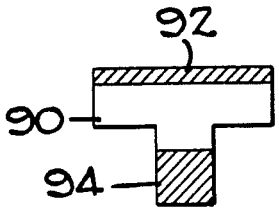
FIG. 11 is a cross section of an elongated T-shaped bar that has been processed in accordance with the present invention to form residual compressive stress in equal balance in the top and bottom of the bar.

If a rectangular or square component is to be processed, the induction heating coil 40 and quenching liquid coil 42 would be shaped to conform closely to the shapes of components being processed such that the most advantageous distribution of the residual stresses can be obtained and the components would not be rotated. If a T-shaped beam 90 (FIG. 11), for example, was to be processed and it was desired to heat treat only the upper flange 92 and lower flange 94, but not the central web, two spaced induction coils (not shown) and two quenching coils formed in the shape of the upper and lower flanges would be used in place of the coils 40 and 42 (FIG. 1), and the T-beam would not be rotated. It will also be understood that if it is desired that T-shaped or I-shaped beams are not to be linear after processing, but is desired that the beam has a slight arcuate shape, only the upper portion of the beam will be induction heated and quenched under tension.

It will further be understood that components to be processed may vary in thickness throughout their lengths. In order to provide uniform heating and cooling to the components at varying thickness, the carriage 46 (FIG. 1) would be driven slower when moving past thick sections of the member than when moving past thin sections; or alternately, the tensioning force may be varied to provide uniform residual stresses throughout the length of the component.

The bars or components to be processed may be formed from any metal that has properties similar to steel of the type which softens before it melts. Also, the process of providing compressive forces at the outer surface of the bar is useable with mild steel such as AISI 1030 and below steels which do not harden. However, it is recognized that many alloy steels such as AISI 4140; AISI 4150 and AISI 4340 are hardened when being processed in accordance with the present invention which further improves the fatigue life of the bar. It is necessary that the material of which the bar is made will have specific general characteristics such as having lower yield strength at elevated temperatures, and having plastic behavior over a considerable range of elevated temperatures. Most carbon steels and steel alloys will have the properties required.

As indicated above, the steel may be hardenable which is preferred in many cases since this produces a case hardened bar thereby providing a higher yield stress in the surface layers or annulus. The residual compressive stresses may be then limited to a smaller area and this would allow the average tensile stresses to be lower since they are distributed over a larger area. Case hardening also provides other desirable effects such as improving wear resistance which would be desirable for track pins used in construction equipment where the track pins normally are not equipped with elastomer bushings.

When the bar being processed has a uniform cross section, a constant stretching force is required when heating and quenching in order to produce uniform axial residual stresses along its length. If the cross sectional area varies along the length of the bar, the tensioning force may be varied to obtain uniform residual stresses.

In regard to the tubular bars B'' and B'''' of FIGS. 8 and 10 of the types used as track shoe pins, many track shoe pins are presently being used with the internal surfaces being rough machined which at present have no affect on their performance. However, when the outside surface is processed in accordance with the present invention to provide residual compressive stress therein, fatigue failure will start on the rough inside surfaces since some areas would experience high tensile stresses from the bending loads. The fatigue life of such tubular track pins are improved by providing a smooth surface finish in the inside surface of the tubular bar. Likewise, improved fatigue life of bars processed in accordance with the present invention occurs when the outer surface of the bar has a smooth finish.

In operation, when the induction heating and quenching has been performed while the bar B (FIG. 1) is being subjected to high tensile forces, it is possible to obtain residual surface stresses in the outer annulus 66 which approach the yield strength of the outer surface of the bar. The reason for this is as the surface layers or annulus become hot, the yield strength of these layers become very low and even approach 0 value while the yield strength of the cooler center sections remains close to its initial value. By keeping the bars under such high tension that the stresses in the center section are approaching yield, the bar will elongate slightly and this will cause the outer layers to yield as they have little or no yield strength while hot. Immediately following the stretching and heating operation the surface layers are quenched while tension is maintained on the bar, the quenched surface layers or annulus now regains a high yield strength but are still at very low stress levels as long as the bar is under tension. When the tension on the cool bar is released, the bar will shorten slightly and compressive stresses will be developed in the surface layers; When the total force of the compressive stresses in the surface layers equals the force developed by the tensile stresses of the center section or core, the bar is at its final length. Depending on the outside force and ratio between the cross sectional areas of the core and the surface layers or annulus, the final residual compressive stresses could be as high as the yield strength of the material.

Depending upon the cross sectional shape of the components, the material of which it is made, and its intended use, an optimum stress distribution will exist; this optimum stress distribution may be determined by means of theoretical analyses. The ideal stress distribution is to never have tensile stresses exceeding the endurance stress limit but, since this may not always be possible, the alternative is to keep the tensile stresses as low as possible and to have the highest tensile stresses occur where they are least likely to cause damage, such as deep inside the component.

Elongated components for which this method will be used must be treated such that the residual compressive and tensile stresses are balanced with respect to the neutral axis of the cross section unless bowing is desired; this is a requirement necessary to keep the elongated section from warping or bowing along its length. As mentioned previously, bowing may be desired with I-beams or T-beams when used in special cases.

From the foregoing description it is apparent that the fatigue life of a component or bar may be improved by induction heating and thereafter quenching the component while the component is being subjected to a tensile force which stretches the bar slightly. After cooling the outer annulus and releasing the tensile force acting to stretch the bar, high residual compressive stresses are present in the outer annulus of the bar thereby greatly improving the fatigue life of the bar.

Although the best mode contemplated for carrying out the present invention has been herein shown and described, it will be apparent that modification and variation may be made without departing from what is regarded to be the subject matter of the invention.

What is claimed is:

1. An elongated axially extending metal component as an article of manufacture having properties of softening before melting when subjected to being quickly heated to a high temperature while being axially stressed and thereafter being quickly cooled for creating ligh residual compressive stresses in an outer layer for providing an improved fatigue life when subjected to outside loads and/or bending loads comprising:

a thin outer member having high residual compressive stresses of at least 10,000 psi therein acting on a small area, and an inner core integral with said outer member and having residual tensile stresses therein acting in a second direction on a large area to provide equal internal forces in opposite directions when outside forces acting on said axially extending metal component are absent.

2. An article of manufacture according to claim 1 wherein said axially extending metal component is an axially elongated bar having a circular cross section throughout its length.

3. An article of manufacture according to claim 1 wherein said axially extending metal component is an axially elongated tubular member having fixed inner and outer diameters throughout the length of the component, said inner core being tubular in configuration.

4. An elongated axially extending component as an article of manufacture having an improved fatigue life when subjected to outside tensile loads and/or bending loads comprising:

an outer member having high residual compressive stresses of at least 10,000 psi therein acting on a small area, and an inner core integral with said outer member and having residual tensile stresses therein acting on a large area to provide equal internal forces in the opposite direction when outside forces are absent.

5. An article of manufacture according to claim 4 wherein said elongated axially extending component is a bar having a circular cross section through at least a major portion of its length.

6. An article of manufacture according to claim 4 wherein said elongated axially extending component is a tubular member having fixed inner and outer diameters throughout the length of the component, said inner core being tubular in configuration.

7. An article of manufacture according to claim 4 having a cross section having at least one flat area.

8. An article of manufacture according to claim 7 having at least one thin outer surface area having high residual compressive stresses.

9. An article of manufacture according to claim 4 wherein said elongated component has a rectangular cross-section.

10. An article of manufacture according to claim 4 wherein said elongated component has a T-shaped cross section.

11. An elongated axially extending component as an article of manufacture having improved fatigue life when subjected to outside tensile and/or bending loads comprising:

an outer member having an elongated axis and formed from a metal having properties of or similar to steel of the type that softens before melting and has high residual compressive stresses therein of at least 10,000 psi acting on a small area in the direction of said elongated axis;

an inner core integral with said outer member having residual tensile stresses therein acting on a large area to provide equal internal forces in opposite directions when outside forces are absent.

12. An article of manufacture according to claim 11 wherein said outer member is formed from a metal having properties similar to hardenable steel of the type that softens before melting and has high residual compressive stresses of at least 10,000 psi.

13. An article according to claim 11 wherein the component is an elongated T-beam, and wherein flanged portions of a wide section and a narrow section of the T-beam have high residual compressive stresses therein, and wherein an intermediate portion has high residual tensile stresses therein.

* * * * *